US009089171B2

(12) United States Patent
Chen

(10) Patent No.: US 9,089,171 B2
(45) Date of Patent: Jul. 28, 2015

(54) BRASSIERE STRUCTURE

(71) Applicant: Sing Young Hong Ltd., Taipei (TW)

(72) Inventor: Pai-Chien Chen, Taipei (TW)

(73) Assignee: SING YOUNG HONG LTD., Taipei (TW)

( * ) Notice: Subject to any disclaimer, the term of this patent is extended or adjusted under 35 U.S.C. 154(b) by 0 days.

(21) Appl. No.: 14/151,876

(22) Filed: Jan. 10, 2014

(65) Prior Publication Data

US 2014/0342638 A1 Nov. 20, 2014

(30) Foreign Application Priority Data

May 17, 2013 (TW) ..... 102209305 U

(51) Int. Cl.
*A41C 3/00* (2006.01)
*A41C 3/06* (2006.01)

(52) U.S. Cl.
CPC ..... *A41C 3/065* (2013.01); *A41B 2400/38* (2013.01); *A41C 3/0028* (2013.01); *A41C 3/0071* (2013.01)

(58) Field of Classification Search
CPC ..... A41C 3/00; A41C 3/065; A41C 3/0078; A41C 3/06
USPC ..... 450/38, 54–57, 81, 86, 88; 623/7, 8; 2/267
See application file for complete search history.

(56) References Cited

U.S. PATENT DOCUMENTS

| | | | | |
|---|---|---|---|---|
| 3,257,952 | A * | 6/1966 | McCormick | 417/383 |
| 6,231,424 | B1 * | 5/2001 | Valentin | 450/81 |
| 6,383,055 | B2 * | 5/2002 | Valentin | 450/81 |
| 6,397,391 | B2 | 6/2002 | DeMarco | |
| 7,335,086 | B1 * | 2/2008 | Karon et al. | 450/81 |
| D583,127 | S | 12/2008 | Deal | |
| 7,677,952 | B2 * | 3/2010 | Wooley | 450/81 |
| D666,386 | S * | 9/2012 | Deal et al. | D2/706 |
| 2005/0079796 | A1 * | 4/2005 | Chou | 450/81 |
| 2005/0260921 | A1 * | 11/2005 | Silver et al. | 450/81 |
| 2006/0217035 | A1 * | 9/2006 | Silver et al. | 450/81 |
| 2008/0051004 | A1 * | 2/2008 | Karon | 450/81 |
| 2009/0093190 | A1 * | 4/2009 | Wooley | 450/41 |
| 2013/0012100 | A1 | 1/2013 | Chen | |
| 2014/0057528 | A1 * | 2/2014 | Deal et al. | 450/38 |

* cited by examiner

*Primary Examiner* — Gloria Hale
(74) *Attorney, Agent, or Firm* — McClure, Qualey & Rodack, LLP

(57) ABSTRACT

A brassiere structure is provided. The brassiere structure comprises two cups and two lateral wings. Each of the cups has a first attachment structure. Each of the lateral wings has a second attachment structure and an adhesive layer. The second attachment structure is detachablely attached on the first attachment structure, and the adhesive layer is sticking on a lateral of each of the breasts.

10 Claims, 5 Drawing Sheets

BRASSIERE STRUCTURE

This application claims priority to Taiwan Patent Application No. 102209305 filed on May 17, 2013.

CROSS-REFERENCES TO RELATED APPLICATIONS

Not applicable.

BACKGROUND OF THE INVENTION

1. Field of the Invention

The present invention relates to a brassiere structure.

2. Descriptions of the Related Art

Women usually wear brassieres to effectively shape the breasts. Various kinds of strapless brassieres have been developed to prevent the shoulder straps of the brassiere from being exposed when women wear garments that expose the shoulders or the back.

As an example, Taiwan Utility Model Patent No. M263764 has disclosed a conventional self-adhesive brassiere that does not have shoulder straps but has two lateral wings undetachably located at the lateral sides of the cups instead. The lateral wings have an adhesive that allows for repeated adhesion so that the lateral wings can stick to the lateral sides of the breasts of a human body. However, the stickiness of the lateral wings tends to decrease after repeated use. Because the lateral wings are undetachable from the cups, conventional brassieres have to be discarded in its entirety, which is wasteful. Moreover, the angle between the lateral wings relative to the cups is invariable, so conventional brassiere structures cannot be used for breasts of different shapes; instead, different brassieres must be produced for different breast shapes. This increases production costs.

Accordingly, it is important to provide a brassiere structure that can overcome the aforesaid shortcomings.

SUMMARY OF THE INVENTION

An objective of the present invention is to provide a brassiere structure which allows for the replacement of the lateral wings thereof and conforms to various breast shapes.

To achieve the aforesaid objective, the brassiere structure of the present invention comprises two cups and two lateral wings. The cups are connected to each other to correspond to two breasts of a human body respectively. Each of the cups has a first attachment structure. Each of the lateral wings has a second attachment structure and an adhesive layer. The second attachment structure is detachably attached on the first attachment structure. Each of the lateral wings is connected to the corresponding cup through the first attachment structure and the second attachment structure so that the adhesive layer sticks on a lateral side of each of the breasts.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
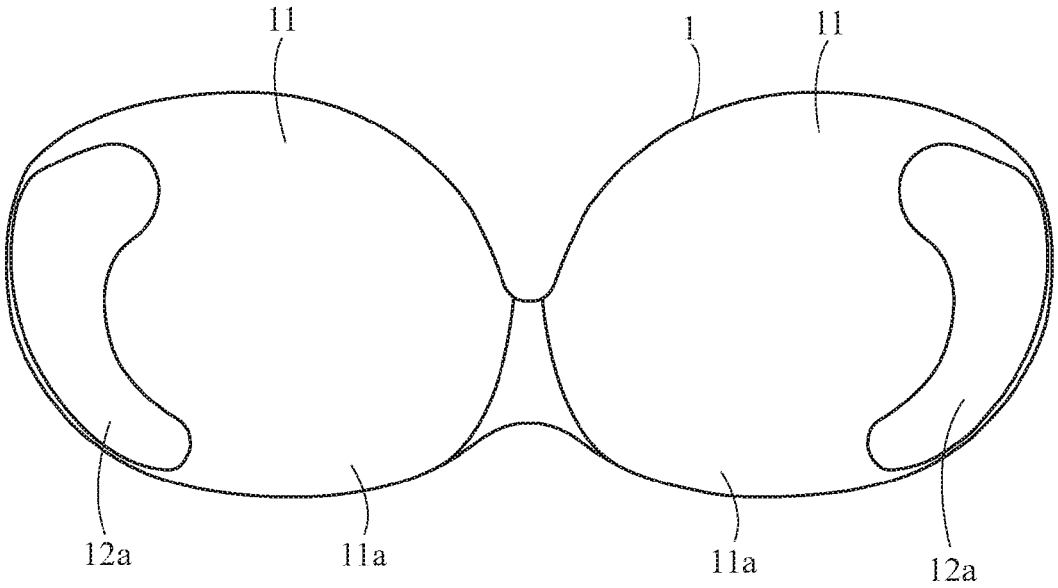
FIG. 1 is a schematic view of a brassiere structure according to a first embodiment of the present invention.
Figure 2:
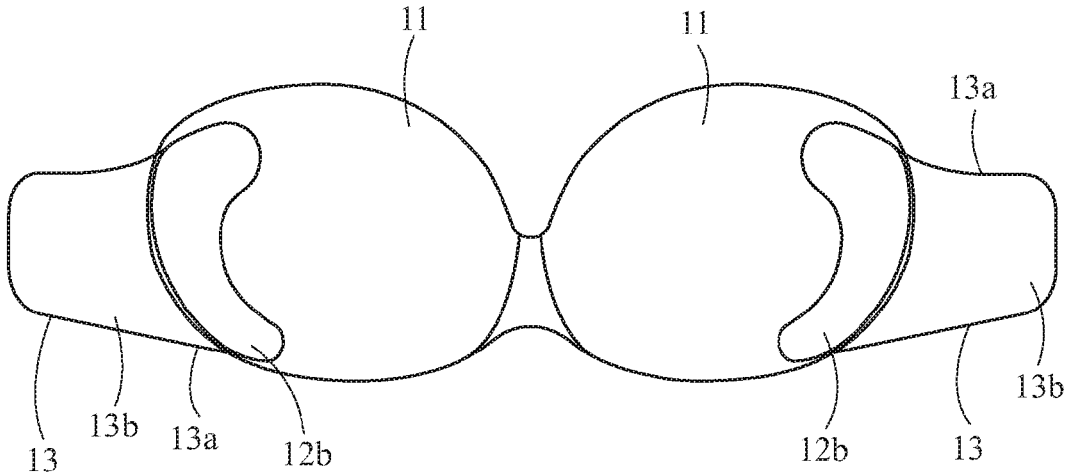
FIG. 2 is another schematic view of the brassiere structure according to the first embodiment of the present invention.
Figure 3:
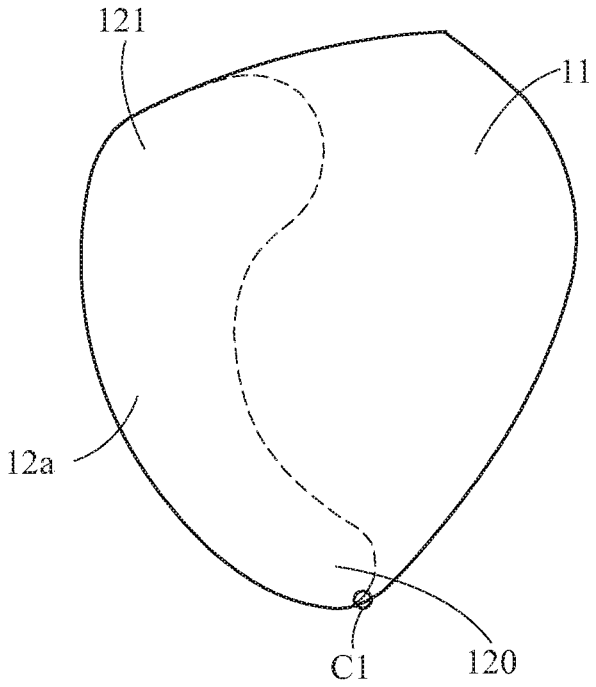
FIG. 3 is a schematic side view of the brassiere structure according to the first embodiment of the present invention.
Figure 4:
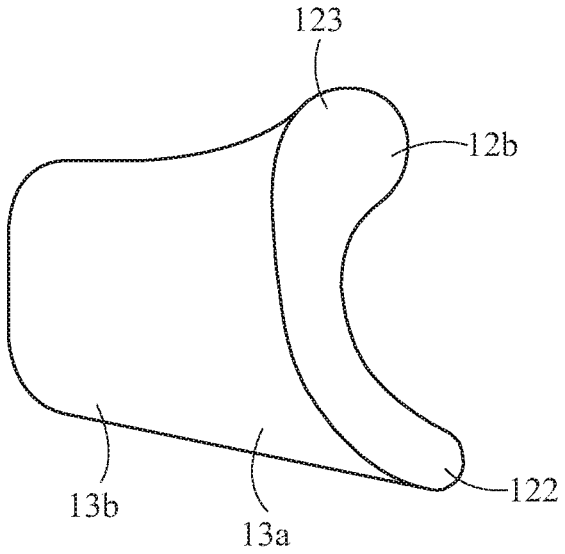
FIG. 4 is a schematic view of a lateral wing of the brassiere structure according to the first embodiment the present invention.
Figure 5:
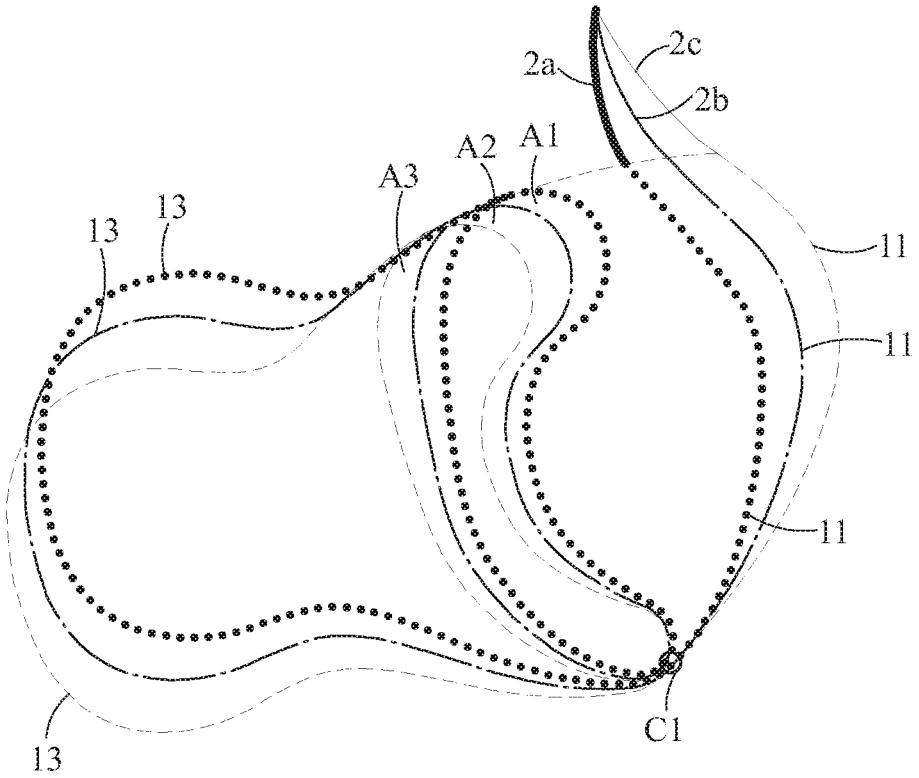
FIG. 5 is a schematic view illustrating the relative relationships between the breast and the brassiere structure according to the first embodiment of the present invention.

The present invention relates to a brassiere structure. FIG. 1 is a schematic view of a brassiere structure 1 according to a first embodiment of the present invention; FIG. 2 is another schematic view of the brassiere structure 1 according to the first embodiment of the present invention; FIG. 3 is a schematic side view of the brassiere structure 1 according to the first embodiment of the present invention; FIG. 4 is a schematic view of a lateral wing 13 of the brassiere structure 1 according to the first embodiment of the present invention; and FIG. 5 is a schematic view of relative relationships between a breast and the brassiere structure 1 according to the first embodiment of the present invention.

The brassiere structure 1 according to this embodiment comprises two cups 11 and two lateral wings 13. The two cups 11 are connected to each other to correspond to two breasts of a human body respectively. Each of the cups 11 has a first attachment structure 12*a*. Each of the lateral wings 13 has a second attachment structure 12*b*, an adhesive layer 13*a* and a protective layer 13*b*. The second attachment structure 12*b* can be detachably attached on the first attachment structure 12*a* so that each of the lateral wings 13 can be connected to the corresponding cup 11 through the first attachment structure 12*a* and the second attachment structure 12*b*. That is, the second attachment structure 12*b* can be attached on the first attachment structure 12*a* or directly detached from the first attachment structure 12*a* as desired. The protective layer 13*b* is detachably attached on the adhesive layer 13*a*. When the brassiere structure 1 is worn by a user, the adhesive layer 13*a* corresponds to lateral sides of the breasts to attach the brassiere structure 1 onto the user's breasts. If the adhesive layer 13*b* becomes less sticky due to repeated use, the user only needs to detach the first attachment structure 12*a* from the second attachment structure 12*b* and replace the lateral wings with new ones.

In other embodiments of the present invention, the adhesive layers of the lateral wings may not be protected by the protective layers, in which case the adhesive layers of the respective lateral wings may be attached to each other to protect the stickiness of the adhesive layers when the lateral wings are not used.

In this embodiment, the first attachment structure 12*a* is the first attachment member, while the second attachment structure 12*b* is the second attachment member. The first attachment member is fixed to the corresponding cup 11. Each of the lateral wings 13 is fixed to the corresponding second attachment member so that each of the lateral wings 13 and the corresponding cup 11 are connected to each other through the first attachment member and the second member.

It shall be appreciated that in this embodiment, each of the first attachment structures 12*a* is located on an inner surface 11*a* of the corresponding cup 11. The inner surface 11*a* is a concave surface, to which the breast of the user will be attached when the brassiere structure 1 of this embodiment is worn by the user. However, the first attachment structure 12*a* is not limited to the aforesaid location as long as the first attachment structure 12*a* and the second attachment structure 12*b* can correspond to and be attached to each other. In other embodiments of the present invention, the first attachment structure 12*a* may also be located on an outer surface (i.e., a convex surface) of the cup with the second attachment structure 12*b* of the lateral wing attached to the first attachment structure 12*a*. More specifically, each of the first attachment structures 12*a* may be located on a fringe area of the corresponding cup 11 in this embodiment. However, each of the first attachment structures is not limited to the aforesaid location; rather, the first attachment structure may be disposed at any location where it can be fixed to the cup on the second attachment structure.

In this embodiment, the first attachment structure 12*a* and the second attachment structure 12*b* may be formed of a hook and loop set. However, in other embodiments of the present invention, the first attachment structure is a part of the cup; i.e., the cup may be formed of a piece of loop cloth. Because the first attachment structure is a part of the cup, the first attachment structure also has a loop structure for use as the loop member so that the second attachment structure serving as the hook member can be easily attached onto the first attachment structure. Likewise, in other embodiments of the present invention, the lateral wing may be formed from a piece of loop cloth. The second attachment structure is a part of the lateral wing, so the second attachment structure also has a loop structure for use as a loop member so that the first attachment structure serving as the hook member can be easily attached onto the second attachment structure.

Figure 6:
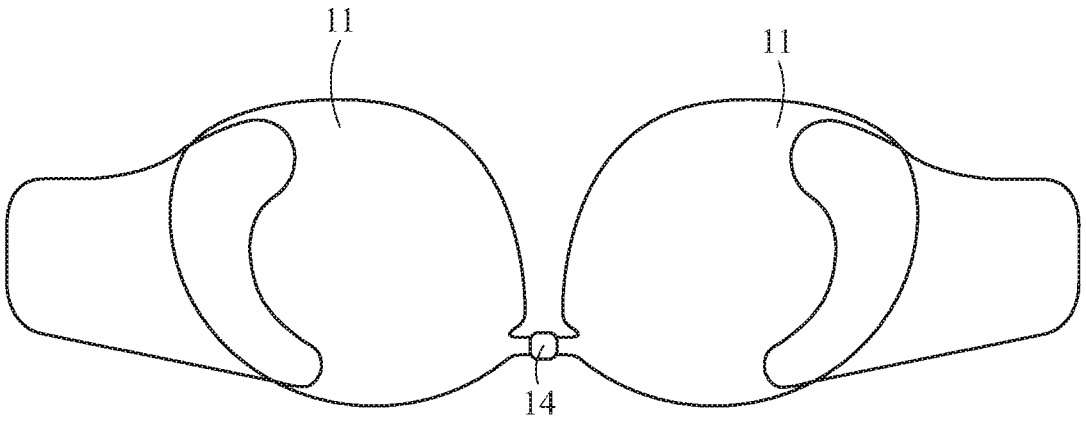
FIG. 6 is a schematic view of a brassiere structure according to another embodiment of the present invention.

Furthermore, in a brassiere structure according to another embodiment of the present invention as shown in FIG. 6, the cups 11 are connected to each other through a buckle set 14. Thus, the user can connect the cups 11 together or disconnect the cups 11 from each other by closing or opening the buckle set 14.

The first attachment structure 12*a* has a first end 120 and a second end 121, while the second attachment structure 12*b* has a third end 122 and a fourth end 123. When the first attachment structure 12*a* is attached onto the second attachment structure 12*b*, the first end 120 is attached onto the third end 122 and the second end 121 is attached on the fourth end 123.

In order for the brassiere structure 1 to conform to the breast shapes of different users, the first end 120 is defined with a reference center C1. The area of the second end 121 of the first attachment structure 12*a* is greater than an area of the fourth end 123 of the second attachment structure. The second attachment structure 12*b* is adapted to rotate about the reference center C1 by an angle with respect to the first attachment structure 12*a*, and is then attached onto the first attachment structure 12*a*.

In detail, as shown in FIG. 5, if the user has a breast 2*a* of a first size, then the second attachment structure 12*b* may be rotated about the reference center C1 to a first location A1 with respect to the first attachment structure 12*a* to prevent a gap from forming between the breast 2*a* and the cup 11 to cause inadequate attachment therebetween. At the first location A1, the second attachment structure 12*b* becomes closer to the cup 11 at the first location A1. Next, the second attachment structure 12*b* is attached onto the first attachment structure 12*a*. The adhesive layer 13*a* of the lateral wing 13 is adhered to a lateral side of the breast 2*a* so that the brassiere structure 1 can be properly fixed to the user's breast.

Furthermore, if the user has a breast 2*b* of a second size, the second attachment structure 12*b* may be rotated about the reference center C1 to a second location A2 with respect to the first attachment structure 12*a* to prevent inadequate attachment between the breast 2*b* and the cup 11. At the second location A2, the second attachment structure 12*b* is located approximately in a center region of the first attachment structure 12*a*. Next, the second attachment structure 12*b* is attached onto the first attachment structure 12*a*, and then the adhesive layer 13*a* of the lateral wing 13 is adhered to a lateral side of the breast 2*b* so that the brassiere structure 1 can be properly fixed to the user's breast.

Also, if the user has a breast 2*c* of a third size, then the second attachment structure 12*b* may be rotated about the reference center C1 to a third location A3 with respect to the first attachment structure 12*a* to prevent the breast 2*b* from being pressed by the cup 11. At the third location A3, the second attachment structure 12*b* becomes farther from the cup 11. Next, the second attachment structure 12*b* is attached onto the first attachment structure 12*a*. Then, the adhesive layer 13*a* of the lateral wing 13 is adhered to a lateral side of the breast 2*c* so that the brassiere structure 1 can be properly fixed to the user's breast.

To assist the user in aligning the second attachment structure 12*b* with the reference center C1 and rotating the second attachment structure 12*b*, a shape of the first end 120 of the first attachment structure 12*a* is formed to correspond to a shape of the third end 122 of the second attachment structure 12*b*. Thereby, the user can properly align the second attachment structure 12*b* with the reference center C1 by aligning the shape of the third end 122 with the shape of the first end 120.

Figure 7:
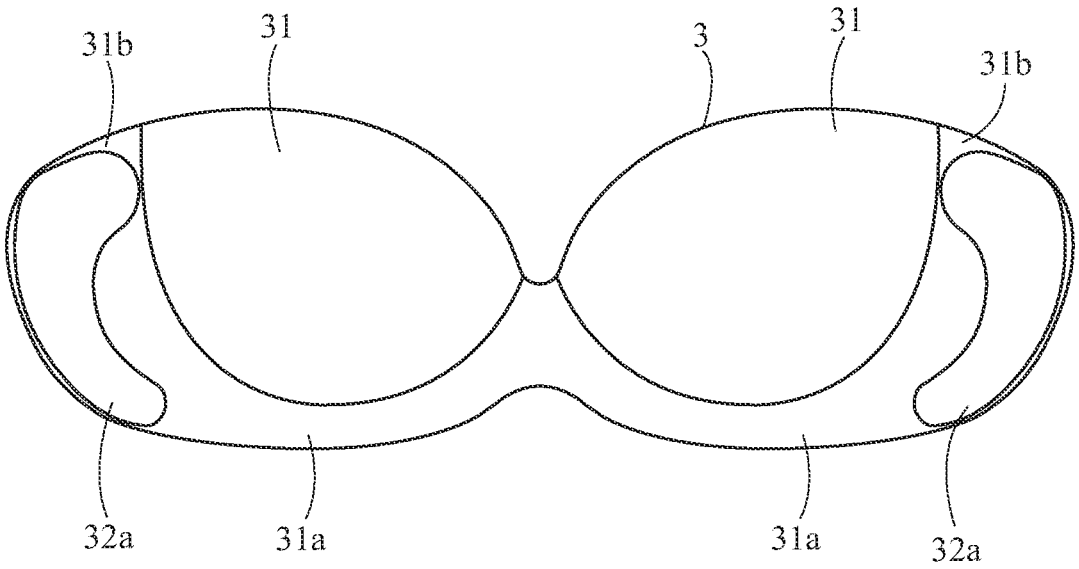
FIG. 7 is a schematic view of a brassiere structure according to a second embodiment of the present invention.
Figure 8:
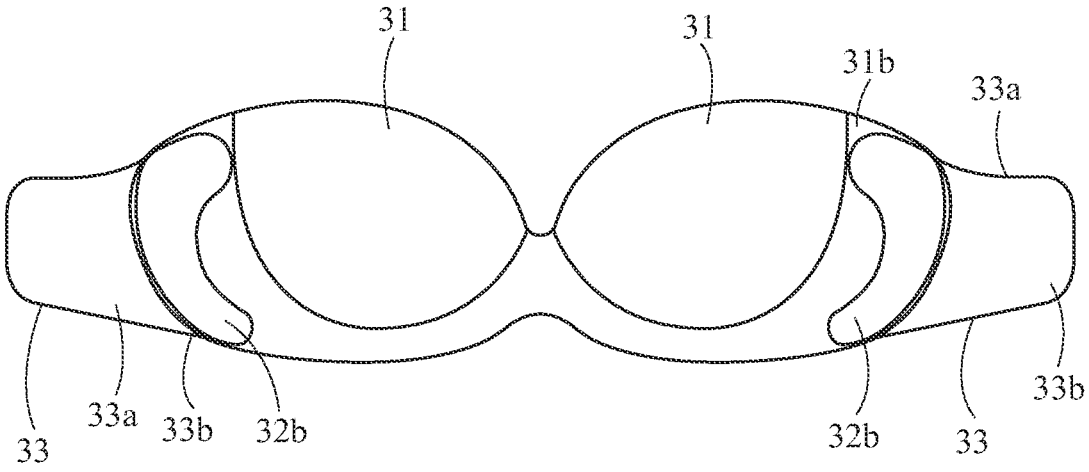
FIG. 8 is another schematic view of the brassiere structure according to the second embodiment of the present invention.

FIGS. 7 and 8 show schematic views of a brassiere structure 3 according to a second embodiment of the present invention. As in the first embodiment, the second embodiment also comprise two cups 31 and two lateral swings 33. The two cups 31 are connected to each other to correspond to two breasts of a human body. Each of the cups 31 has a first attachment structure 32*a*. Each of the lateral wings 33 has a second attachment structure 32*b*. The first attachment structure 32*a* is a first attachment member while the second attachment structure 32*b* is a second attachment member. The first attachment member is fixed to the corresponding cup 31, while the second attachment member is detachably attached on the first attachment member. Each of the lateral wings 33 has an adhesive layer 33*a* and a protective layer 33*b*. Each of the lateral wings 33 is fixed to the corresponding second attachment structure 32*b* so that the lateral wing 33 is connected to the corresponding cup 31 through the first attachment structure 32*a* and the second attached structure 32*b*. The protective layer 33*b* is detachably attached onto the adhesive layer 33*a*. When the brassiere structure 3 is worn by a user, the adhesive layer 33*a* will stick to the lateral sides of the breasts to attach the brassiere structure 1 to the user's breasts. If the adhesive layer 33*b* is no longer sticky due to repeated use, the user only needs to detach the first attachment structure 32*a* from the second attachment structure 32*b* and replace the lateral wings with new ones.

This embodiment differs from the first embodiment in that each of the cups 31 further has an extended strip 31*b* extending from a peripheral region of the cup 31 with the first attachment structure 32*a*. In other embodiments of the present invention, the first attachment structure 32*a* and the second attachment structure 32*b* may be formed of a hook and loop set. Each of the extended strips may be a piece of loop cloth. Because the first attachment structure is a part of the extended strip, the first attachment structure also has a loop structure for use as the loop member; and therefore, the second attachment structure serving as a hook member can be easily attached onto the first attachment structure.

Similarly in this embodiment, the user may also rotate the second attachment structure 32*b* by an angle with respect to the first attachment structure 32*a* so that the brassiere structure conforms to her own breast shape. This is just the same as what has already been described in the first embodiment, so no further description will be made herein. In other embodiments of the present invention, the adhesive layers of the lateral wings may not be protected by the protective layers, in which case, the adhesive layers of the respective lateral wings may be attached to each other to protect the stickiness of the adhesive layers when the lateral wings are not used.

As in the first embodiment of the present invention, each of the first attachment structures 32*a* is located on an inner surface 31*a* of the corresponding cup 31. The inner surface 31*a* is a concave surface, to which the breast of the user will be attached when the brassiere structure 3 of this embodiment is worn by the user. However, the first attachment structure 32*a* is not limited to the aforesaid location as long as the first attachment structure 32*a* and the second attachment structure 32*b* can correspond to and be attached to each other. In other embodiments of the present invention, the first attachment structure 32*a* may also be located on an outer surface (i.e., a convex surface) of the cup with the first attachment structure of the lateral wing being attached onto the second attachment structure.

According to the above descriptions, through the design of the first attachment structure and the second attachment structure, the brassiere structure of the present invention can provide detachable lateral wings, and allow the tilting angle of the lateral wings with respect to the cups to be adjusted depending on the user's desires so that breast shapes of different users can be accommodated.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A brassiere structure, comprising:

two brassiere cups, being connected to each other, and each having a concave surface and a first attachment structure of a first size configured thereon; and two lateral wings, each of which has two sides, a second attachment structure of a second size on one side and an adhesive layer on the other side, wherein the first size is greater than the second size, and each second attachment structure is detachably attached on the corresponding first attachment structure.

2. The brassiere structure of claim 1, wherein the first attachment structure has a first lower portion to be a first end, and the second attachment structure has a second lower portion to be a second end.

3. The brassiere structure of claim 1, further comprising a detachable buckle set, wherein the two brassiere cups are connected to form a connection through the detachable buckle set.

4. The brassiere structure of claim 3, wherein each brassiere cup has a fringe area located on an end thereof opposite to that where the detachable buckle set is formed, and each first attachment structure is located on a respective fringe area.

5. The brassiere structure of claim 1, wherein the two connected brassiere cups form a connection therebetween, each brassiere cup has a fringe area located on an end thereof opposite to that where the connection is formed, and each the first attachment structure is located on the respective fringe area.

6. The brassiere structure of claim 1, wherein each lateral wing has a protective layer that is detachably attached on the adhesive layer.

7. The brassiere structure of claim 2, wherein the first end has therein a first reference center, the second end has therein a second reference center, and each second attachment structure is detachably attached to the corresponding first attachment structure in a configuration that the first reference center superimposes on the second reference center.

8. The brassiere structure of claim 7, wherein each second attachment structure is detachably attached to the corresponding first attachment structure in the configuration that the first reference center superimposes on the second reference center and each second attachment structure is configured with the corresponding first attachment structure in a specific angle along a specific position of the corresponding concave surface.

9. A brassiere structure comprising two brassiere cups, each of which comprises:

a concave surface;

a cup having an upper edge and a lower edge;

an extended strip extended from the lower edge, wherein the two extended strips are connected to each other to form a connection in a configuration that the two upper edges are symmetrical;

a first attachment structure having a first size disposed on the extended strip, and positioned on the respective concave surface at an end thereof opposite to that where the connection is formed;

a lateral wing having a second attachment structure of a second size and an adhesive layer, wherein the first size is greater than the second size, and the second attachment structure is detachably attached to the first attachment structure.

10. A brassiere structure, comprising:

two brassiere cups connected to each other, and each having a concave surface, and a first attachment structure of a first size configured thereon, wherein each concave surface forms the respective first attachment structure; and two lateral wings, each of which has two sides, a second attachment structure of a second size on one of the two sides and an adhesive layer on the other side, wherein the first size is greater than the second size, and each second attachment structure is detachably attached on the corresponding first attachment structure.

* * * * *